United States Patent [19]

Cluzel et al.

[11] 4,197,920

[45] Apr. 15, 1980

[54] UNDERWATER ACOUSTIC REFLECTORS

[75] Inventors: Philippe H. Cluzel; Michel G. Quivy, both of Six-Fours-les-Plages; Bernard Tocquet, Sanary sur Mer, all of France

[73] Assignee: Etat Francais represented by the Délegué Génetal pour l'Armement, Paris, France

[21] Appl. No.: 21,318

[22] Filed: Mar. 16, 1979

[30] Foreign Application Priority Data

Mar. 23, 1978 [FR] France ..... 78 08430

[51] Int. Cl.[2] ..... G10K 11/00

[52] U.S. Cl. ..... 181/175; 204/DIG. 6; 367/151

[58] Field of Search ..... 181/175, 233, 234, 235; 429/4, 6, 119, 242; 340/8 FT; 204/242, 252, 271, 282, 283, DIG. 6

[56] References Cited

U.S. PATENT DOCUMENTS

| | | | |
|---|---|---|---|
| 1,348,828 | 8/1920 | Fessenden | 181/175 |
| 1,378,420 | 5/1921 | Merritt | 181/175 |
| 3,069,486 | 12/1962 | Solomon et al. | 429/242 |
| 3,901,352 | 8/1975 | Cluzel | 181/175 |
| 4,086,155 | 4/1978 | Jonviile | 204/252 |

*Primary Examiner*—L. T. Hix
*Assistant Examiner*—Benjamin R. Fuller
*Attorney, Agent, or Firm*—Stevens, Davis, Miller & Mosher

[57] ABSTRACT

An underwater acoustic reflector and method for making an acoustic underwater reflector is described herein whereby electrodes are immersed in an aqueous electrolyte solution and thereafter connected to a supply of electrical current. The electrodes are selected such that bubbles form on at least one of the electrodes, providing a layer of acoustic reflective bubbles. Control of the reflectivity properties according to the intensity of the electrolyzing current is also described.

13 Claims, 3 Drawing Figures

UNDERWATER ACOUSTIC REFLECTORS

BACKGROUND OF THE INVENTION

The present invention relates to underwater acoustics, particularly submarine acoustics. Specifically, underwater acoustic reflectors and processes for obtaining the same are disclosed herein.

It is known that to improve the efficiency and ability to locate emitters or receivers of underwater acoustic waves which have originated from sonar equipment, it is necessary to provide an acoustic reflector placed behind the transducers.

It is equally known that the interface between a layer of gas, for example air, and water constitutes a reflective surface having a large reflective power as a result of the large discontinuity in acoustic impedance between air and water.

It has already been proposed to construct acoustic reflectors containing a volume of air, but these are not suitable for immersion at depths of the order of several hundred or thousands of meters because the volume of air which is compressed by the hydrostatic pressure changes its dimensions and thus the reflective power varies with the depth of immersion.

SUMMARY OF THE INVENTION

The object of the present invention is to develop an acoustic reflector which comprises an interface of a layer of gas and a liquid and which may be used at great depths of immersion without altering its reflective power. This object is attained by fabricating an underwater acoustic reflector according to which two opposed electrodes which are surrounded by an aqueous electrolyte are immersed, at least one of the electrodes being a plate of which the face that is turned towards the other electrode is formed from a material which retains bubbles of gas. When the said electrodes have attained the required depth of immersion, the electrodes are connected to the terminals of a direct current (DC) source and the said electrolyte is electrolyzed by passing a current having an intensity regulated as a function of the depth of immersion, such that said face which retains bubbles of gas becomes covered with an appreciable and continuous reflective layer of fine bubbles of gas produced by the electrolysis of the electrolyte.

Preferably, a layer of fibrous or cellular material which retains gas bubbles is located between the two electrodes.

An underwater acoustic reflector according to the invention comprises two opposed electrodes which are immersed in an electrolyte, more particularly the sea, and which are connected to the two terminals of a DC source by means which allow the intensity of the electrolyzing current to be monitored and regulated. At least one of the two electrodes is a plate, planar or curved, of which the face which is turned towards the other electrode is formed of a material which retains gas bubbles, whereby the face becomes covered with an appreciable and continuous reflective layer of fine gas bubbles provided by the electrolysis of the said liquid. Preferably, the space between the two electrodes is filled with a cellular or fibrous material which retains gas bubbles.

A submarine acoustic reflector according to the invention comprises:

two electrodes in the form of plates, planar or curved, mutually parallel and separated by a small intermediary space;

a layer of a cellular or fibrous electrically insulating material which fills the said intermediary space; and two external plates, positioned adjacent external faces of the two electrodes and formed of an electrically insulating material, said plates having an acoustic impedance which is similar to that of sea water, said plates being connected to each other by rigid fastening means.

The two electrodes may be constituted, for example, by a lattice or mesh of very fine conductive fibers or filaments which are resistant to corrosion—for example, carbon fibers. Alternatively, the two electrodes may be a sintered powder of a conductive material which is resistant to corrosion—for example, sintered nickel.

The invention provides new acoustic reflectors which may be used at great depths of immersion, for example several thousand meters.

In effect, the gas bubbles are formed in place by the electrolysis, and in regulating the intensity of the electrolyzing current as a function of the depth of immersion, it is possible to obtain an almost continuous layer of fine gas bubbles which are trapped in the neighborhood of the electrodes and which constitute a good reflective surface.

Because of the proximity of the electrode, it is not necessary to provide a high voltage. A d.c. voltage of only a few volts is sufficient to electrolyze sea water. Reflectors according to the invention are particularly suitable for sonar equipment used in a submarine. In this case, it is possible to use the submarine batteries to provide the current for the electrolysis.

The cellular or fibrous material placed between the electrodes has the effect of retaining gas bubbles and thus reduces the consumption of current during electrolysis. In the absence of this intermediary material, part of the gas bubbles escape and it is necessary to replace them continuously by electrolysis. Another advantage of the intermediary material which reduces the proportion of escaping gas bubbles is that immersed sonar equipment provided with a reflector according to the invention is less susceptible to detection by the escaping bubbles.

The following description refers to the accompanying drawing which represents, without any limitative character, embodiments of acoustic reflectors according to the invention.

DESCRIPTION OF THE PREFERRED EMBODIMENT

Figure 1:
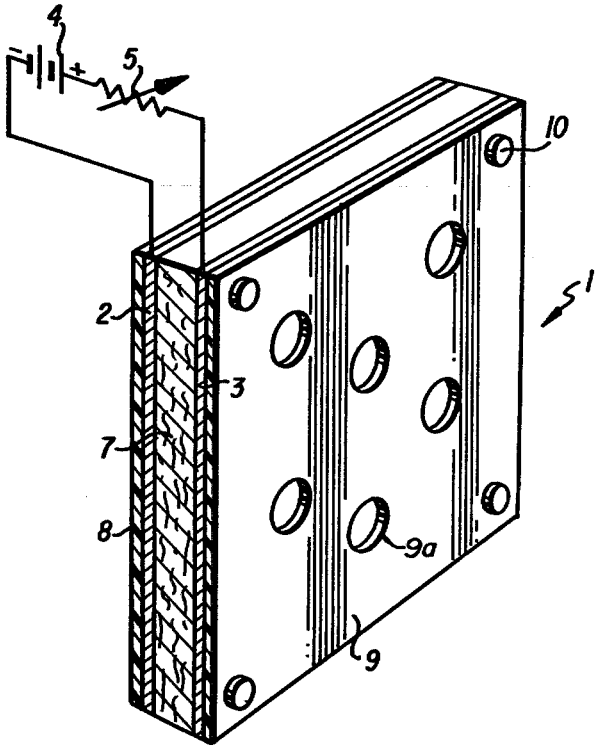
FIG. 1 is a perspective view of an element of a submarine acoustic reflector according to the invention.
Figure 2:
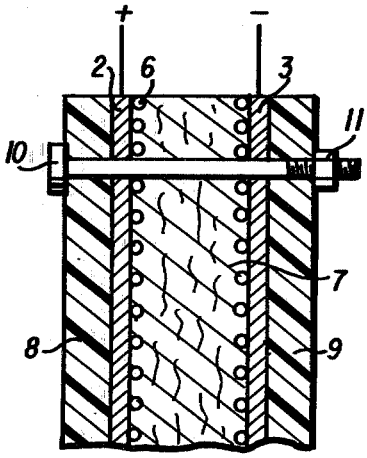
FIG. 2 is a partial section of the reflector shown in FIG. 1.

FIGS. 1 and 2 show an element 1 of a submarine acoustic reflector. This element comprises two electrodes 2 and 3 which are connected to the terminals of a DC source 4, for example a series of accumulators on board a submarine. A variable resistance 5 (or an equivalent device) makes it possible to vary the voltage between the electrodes and to control the intensity of the current which circulates through them.

The two electrodes 2 and 3 have the form of mutually parallel, closely opposed plates and are separated from one another by a small distance, for example a few centimeters.

In the example of FIG. 1, the electrodes are planar but they may also be curved.

The example shown in FIGS. 1 and 2 is a submarine reflector and the two electrodes 2 and 3 are immersed in sea water which is conducting such that when a difference in potential of several volts is established between the electrodes, the sea water is decomposed by electrolysis and gives rise to oxygen and hydrogen which appear in the form of bubbles of gas 6 on the two electrodes.

The electrodes 2 and 3 are provided, at least on their opposing faces, with material which traps bubbles of gas such that their dimensions remain slight and the internal faces of the two electrodes become covered by an appreciable and continuous layer of bubbles, the interface between the water and the layer of bubbles constituting a reflective surface for acoustic waves. The size of bubbles depends on the depth of immersion and on the intensity of the electrolyzing current. It is possible to vary the intensity of the current as a function of the depth to obtain bubbles having dimensions which allow the formation of a layer of bubbles having satisfactory reflective powers at all depths.

The electrodes 2 and 3 are, for example, a lattice or mesh of fine fibers or filaments of a material which is both a good conductor of electricity and has good resistance to corrosion, for example carbon fibers. In this case, the bubbles are retained in the spaces between fibers.

Of course, the electrodes may also be made of a porous material such as a sintered powder, the material itself being a good conductor of electricity and resistant to corrosion. Thus, the electrodes may be formed by plates of sintered nickel. In this case, the gas bubbles are trapped in the pores of the electrodes. The space between the electrodes 2 and 3 is preferably filled with a layer 7 of a cellular or fibrous material which traps a great quantity of gas bubbles and prevents them from detaching themselves from the electrodes and escaping upwards.

The layer 7 is, for example, a synthetic foam, rigid or compliant, with open pores such that the electrolyte can pass through it. The layer 7 may also be made of a fibrous material, for example of glass fiber. Naturally, the material of which the layer 7 is made must be a good electrical insulator, must resist corrosion by sea water and must be permeable to sea water.

The reflective element according to FIGS. 1 and 2 also includes two external plates 8 and 9 located adjacent the external faces of the two electrodes 2 and 3. These plates are connected together by nuts 10 formed of an electrically insulating material, for example a plastics material, and by bolts 11 which are screwed onto the nuts 10.

The plates 8 and 9 are made from an electrically insulating material having an acoustic impedance similar to that of sea water, such that they are acoustically transparent. For example, the plates 8 and 9 may be made of a rigid plastics material such as polyvinyl chloride, polyethylene, or polymethacrylate. The electrodes 2 and 3 may be stuck to the internal faces of the plates 8 and 9 or may be simply held in place by the action of the nuts 10. The plates 8 and 9 preferably include perforations such as 9*a* which encourage circulation of sea water in the space between the electrodes.

FIGS. 1 and 2 show a reflector having a rectangular or square shape. To construct a reflector with a larger surface area, a plurality of reflectors 1 may be juxtaposed and in this case, those electrodes of the different reflector elements with the same polarity should be connected in parallel to the terminals of the current source 4.

FIGS. 1 and 2 show an element of a submarine reflector which is plunged in the sea.

In the case of a reflector which is to be submerged in pure and non-conducting water, for example in a lake, each element 1 is enclosed in a water-tight envelope formed of an acoustically transparent material, the envelope itself being filled with an aqueous electrolyte.

Figure 3:
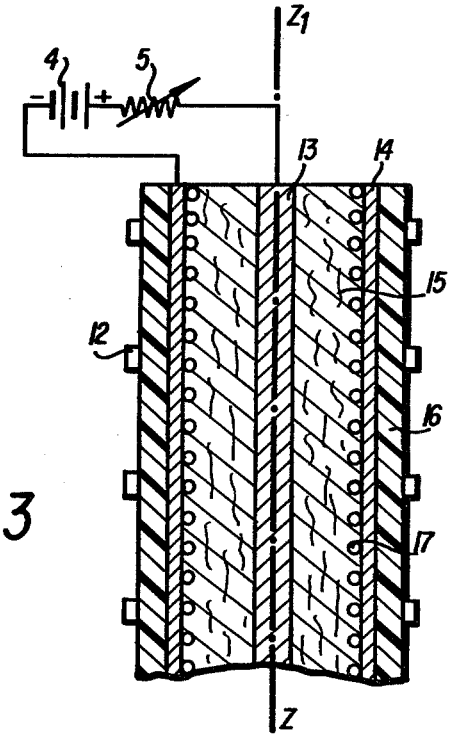
FIG. 3 shows an axial section of a cylindrical antenna of submarine sonar equipment including a reflector according to the invention.

FIG. 3 shows a different embodiment of a reflector according to the invention located in a cylindrical antenna having an axis $Z$–$Z_1$. Such an antenna is often found in underwater acoustic equipment.

In FIG. 3, there are shown a number of electroacoustic transducers 12, for example hydrophones, which are disposed along columns at the exterior of the reflector. The reflector comprises a first central electrode 13 which has the form of a stalk or a rod disposed along the axis. It also comprises a second external electrode 14 of cylindrical form which is co-axial with the electrode 13 and which envelops it. The electrode 14 is, like electrodes 2 and 3, comprised of a material which retains bubbles of gas. More specifically, the electrode 14 like the electrodes 2 and 3 may be formed of a metal or graphite plate carrying, on its internal face only, a lining of material which retains gas bubbles. The space between the central electrode 13 and the cylindrical electrode 14 is preferably filled with a layer 15 of a cellular or fibrous material which is analogous to that forming the layer 7 and has the same function.

The electrode 14 is surrounded by a cylindrical shield 16 formed of an electrically insulating and acoustically transparent material. This shield 16 carries the transducers 12.

In FIG. 3, there is shown a layer 17 of gas bubbles which is formed on the internal face of the electrode 14 as a result of electrolytic decomposition of the electrolyte. This layer 17 is trapped on the electrode 14 and forms the reflective surface.

In order to make a reflector according to the invention, the reflector is first of all immersed and then, when the desired depth of immersion has been attained a current is passed to the electrode to form the layer of bubbles at the position at which the reflector is to be used. When a layer of bubbles has been formed, a current of low intensity is passed to the electrodes for the purpose of replacing any bubbles which escape. It is to be understood that the various elements which have just been described by way of example may be replaced by equivalent elements performing the same functions without departing from the scope of the invention.

What we claim is:

1. A process for constructing an underwater acoustic reflector comprising: immersing two opposed electrodes in an aqueous electrolyte solution, at least one of said electrodes being a plate formed of a material which retains gas bubbles, supplying an electrical voltage to said electrodes whereby a current passes through said electrolyte, regulating the intensity of said current in accordance with the depth of immersion of said electrodes, whereby said one electrode becomes covered with an appreciable and continuous layer of fine bubbles of gas forming a reflective surface.

2. A process as claimed in claim 1, characterized in that a layer of cellular or fibrous material which retains bubbles of gas and which is permeable to the said electrolyte is interposed between the two electrodes.

3. An underwater acoustic reflector characterized in that it comprises two opposed electrodes which are surrounded by an aqueous electrolyte, each of said electrodes are adapted to be connected to one of the two terminals of a DC source by means which permits monitoring and regulation of the intensity of the electrolyzing current, and in that at least one of the two electrodes is a plate, whereby the face of said plate that is turned towards the other electrode is formed from a material which retains gas bubbles, such that said face becomes covered with an appreciable and continuous layer of fine bubbles of gas provided by the electrolysis of said electrolyte, whereby said layer constitutes a reflective surface.

4. A reflector as claimed in claim 3, characterized in that the space between the two electrodes is filled with a cellular or fibrous material which retains bubbles of gas.

5. A submarine acoustic reflector according to claim 4, characterized in that said two electrodes are in the form of plates, mutually parallel and separated by a small intermediary space; a layer of cellular or fibrous electrically insulating material fills said intermediary space; and two external plates are located adjacent the external faces of the two electrodes and formed of an electrical insulating material having an acoustic impedance substantially equal to that of sea water, and means for fastening said external plates together.

6. An acoustic reflector as claimed in claim 5, characterized in that the two electrodes are comprised of a lattice or mesh of fine electrically conductive fibers which are resistant to corrosion.

7. An acoustic reflector as claimed in claim 5, characterized in that the two electrodes are formed of a sintered powder of a material which is electrically conductive and resistant to corrosion.

8. An acoustic reflector as claimed in claim 5, characterized in that the said external plates are perforated.

9. A submarine reflector having a large surface area characterized in that it comprises a plurality of elementary reflectors as claimed in claim 5 which are juxtaposed and which are connected in parallel to the terminals of the said DC source.

10. A submarine reflector as claimed in claim 3, characterized in that one of said electrodes is a central electrode in the form of a rod and the remaining electrode is an external electrode in the form of a hollow cylinder which envelops said central electrode, said external electrode being formed from a material which retains gas bubbles.

11. An acoustic reflector as claimed in claim 3, immersed in a non-conducting liquid, characterized in that the two electrodes are enclosed in a water tight envelope formed of an acoustically transparent material, which envelope is filled with an aqueous electrolyte.

12. The acoustic reflector of claim 3, wherein said aqueous electrolyte is sea water.

13. The acoustic reflector of claim 6, wherein said conductive fibers are carbon fibers.

* * * * *